US005938126A

United States Patent [19]

Rehman et al.

[11] Patent Number: 5,938,126

[45] Date of Patent: Aug. 17, 1999

[54] SPRAY GUN HAVING A CURRENT MONITORED ANTI-BACK-IONIZATION PROBE

[75] Inventors: William R. Rehman, Vermillion; Harry J. Lader, Lakewood; Jeffrey A. Perkins, Amherst, all of Ohio

[73] Assignee: Nordson Corporation, Westlake, Ohio

[21] Appl. No.: 09/046,146

[22] Filed: Mar. 23, 1998

[51] Int. Cl.[6] ..... B05B 5/025

[52] U.S. Cl. ..... 239/707; 239/690

[58] Field of Search ..... 239/690, 707, 239/706, 691, 708

[56] References Cited

U.S. PATENT DOCUMENTS

| | | | |
|---|---|---|---|
| 3,279,429 | 10/1966 | Félici et al. | 239/704 X |
| 3,558,052 | 1/1971 | Dunn | 239/3 |
| 4,135,667 | 1/1979 | Benedek et al. | 239/707 X |
| 4,228,961 | 10/1980 | Itoh | 239/707 X |
| 4,598,870 | 7/1986 | Schloz | 239/707 X |
| 4,713,257 | 12/1987 | Luttermöller | 239/8 X |
| 4,779,564 | 10/1988 | Kiefer et al. | 118/624 |
| 4,921,172 | 5/1990 | Belmain et al. | 239/695 |
| 5,584,931 | 12/1996 | Buhlmann | 118/628 |
| 5,820,938 | 10/1998 | Pank et al. | 427/449 |

FOREIGN PATENT DOCUMENTS

| | | | |
|---|---|---|---|
| 0 574 305 A1 | 12/1993 | European Pat. Off. . | |
| 0 620 045 A1 | 10/1994 | European Pat. Off. . | |
| 2304411 | 11/1976 | France | 239/707 |
| 3132710 | 3/1983 | Germany | 239/707 |
| 3330665 | 3/1985 | Germany | 239/707 |
| 35 10 199 A1 | 10/1986 | Germany . | |
| 40 22 643 C1 | 11/1991 | Germany . | |
| 1406358 | 9/1975 | United Kingdom | 239/707 |

OTHER PUBLICATIONS

Campbell, "Electrostatic charging of powder coating material," Finishing, Jun. 1994, pp. 28, 30.

Acker, "Corona coating of powder without the orange–peel effect," publication unknown, date, unknown.

*Primary Examiner*—Lesley D. Morris
*Attorney, Agent, or Firm*—Rankin, Hill, Porter & Clark LLP

[57] ABSTRACT

A powder spray coating system includes a power source and an electrical supply line connected to the power source. A spray gun sprays powder in a spray pattern onto a part. The spray gun includes an electrode which charges powder as the powder is dispensed from the gun toward the part. The electrode is connected to the electrical supply line. A first current sensing device is located in the electrical supply line measuring gun current between the power source and the electrode. An ion collector or ABI probe is mounted with the gun for collecting free ions produced by the electrode. The collector has a forward portion positioned near the spray pattern and is spaced from the electrode. The collector is connected to a ground line. A second current sensing device is located in the ground line measuring back current between the ion collector and ground. A controller is connected between the power source and the electrode to control the gun current. The controller is also connected to the first and second current sensing devices for controlling the gun current in accordance with the difference between the measured gun current and the back current. By automatically controlling the current between the gun and the part, the present invention controls the field strength and the current between the tip of the gun and the ABI probe, making unnecessary adjustment of the position of the ABI probe in order to maximize the benefits of the probe in situations where the distance between the gun and the part changes.

5 Claims, 2 Drawing Sheets

SPRAY GUN HAVING A CURRENT MONITORED ANTI-BACK-IONIZATION PROBE

BACKGROUND OF THE INVENTION

1. Field of the Invention

This invention relates to electrostatic spray coating systems, and more particularly to use of a device for collecting free ions in an electrostatic spray coating system.

2. Description of the Prior Art

In electrostatic spray coating systems, the coating material is pumped from a supply to one or more spray guns which spray the coating material onto a part to be coated. The coating material may be either in the form of dry particles conveyed in a fluidized air stream or in the form of liquid atomized by the gun. The spray guns may charge the coating particles by means of a high voltage charging electrode. When the coating particles are sprayed from the front of the gun, they are electrostatically attracted to the part to be coated which is generally electrically grounded and suspended from an overhead conveyer in a spray booth. The spray guns are mounted in the spray booth, either in a stationary position or on a reciprocator other device which allows the gun to be automatically moved in a predetermined path. Once these charged coating particles are deposited onto the part, they adhere there by electrostatic attraction until they are conveyed into an oven where they are cured, or, in the case of powder coating, melted to flow together to form a continuous coating on the product.

Anti-back-ionization (ABI) devices or counter-electrodes have been found to be useful in attracting free ions which would otherwise be attracted to the part. When corona charging the powder, a large number of free ions are also generated. Without an ABI device, the free ions are conveyed with the coating material onto the part. This causes a charge to accumulate on the deposited coating layer until the local electric field strength is great enough to cause ionization from the coating layer. This "back-ionization" can disturb the deposited coating and result in craters and other defects in the cured coating. By using an ABI device, these free ions are collected before they reach the part, and the appearance of the surface finish on the part can be improved.

An example of an ABI device is shown in U.S. patent application Ser. No. 08/959,723 assigned to the assignee of the present invention. This patent shows an is ABI probe which provides satisfactory free ion collection. The effective probe length is adjustable, allowing the position of the end of the probe relative to the electrode to be changed, so that the probe position relative to the electrode can be adjusted.

Another example of an ABI device is shown in U.S. Pat. No. 4,921,172, issued to Belmain et al., in the form of a counter-electrode mounted on a powder spray gun on the front of the gun. Yet another example of an ABI device is shown in European Patent Publication No. 0,620,045 in the form of a counter-electrode ring fixedly mounted around the front of the gun. These ABI devices are fixed in position or built into the gun, so that they do not provide easy adjustment or removablity.

A benefit of the ABI probe is that it allows users to reduce dramatically the field strength between the gun and the grounded part as well as to eliminate most of the free ion current to the part. Therefore, development of back ionization is greatly reduced and penetration of Faraday cage areas is greatly facilitated. As a starting point, the ABI probe should be positioned such that the distance between the tip of the gun and the ABI probe is approximately half the distance between the gun and the part. Thus, the same ease of coating of recessed areas can be observed with corona guns as is achieved in tribo applications.

One shortcoming of the ABI probe is that the distance between the gun and the part changes based on the geometry of the part and on changes in the parts assortment. As this distance changes, the positioning of the ABI probe behind the top of the gun must be manually adjusted to provide for maximum positive effect of using the ABI probe as an ion collector. Unfortunately, such manual repositioning of the ABI probe can be rather cumbersome and, as a result, tends to be rarely done in production applications.

SUMMARY OF THE INVENTION

These and other problems are overcome by the current monitored anti-back-ionization device of the present invention. The invention provides a system for monitoring the current from the ABI probe in order to adjust automatically the current to the gun electrode so that the transfer current can be maintained at an optimum level. The adjustment to the gun current is made by a control system in accordance with the measured gun current and the measured current flowing back through the anti-back-ionization probe. The control system thus provides for maximum utilization of the benefits of an ABI probe or free ion collector in a powder spray coating system. By automatically controlling the current between the gun and the part, the present invention controls the field strength and the current between the tip of the gun and the ABI probe, making unnecessary the adjustment of the position of the ABI probe in order to maximize the benefits of the probe in situations where the distance between the gun and the part changes.

In accordance with the present invention, it is recognized that the current to the gun is equal to the current transferred between the gun and the part being sprayed plus the current flowing back through the ABI probe to ground plus any current leakage or loss. A constant current differential should be maintained between the gun and the part in order to maximize the capture of ions and minimize back ionization at the part. In other words, the transfer current, which is the current measured from the part to ground during the coating process, should be maintained at a low value. In accordance with this invention, the gun current and the probe current are measured, and the transfer current is minimized by maintaining the differential between the gun current and the probe current at a desired minimum value equal to the transfer current and current loss.

The control system for the powder spray coating system of the present invention allows users to maintain automatically the supply current to the gun electrode below a certain preset level and, therefore, to keep the ion current from the electrode to the part being coated from rising as the part comes nearer to the gun or as gun is moved closer to the part. Such control over the gun current reduces the development of back ionization on the part, as well as reduces the strength of the electric field between the gun and the part as the gun is moved closer to the part. This reduction in field strength, in turn, results in improved penetration of recessed areas on the part.

The control system of the present invention thus allows users to control automatically the current between the gun and the part and to maintain this current at a low level. The transfer current can thus be maintained at the lowest level necessary to efficiently coat the part, for example at about 10 $\mu$A, and excess transfer current is avoided, minimizing field strength and back ionization.

By carefully controlling the transfer current in accordance with the present invention, the transfer efficiency is improved, and the surface appearance of the sprayed part is improved by decreasing the degree of back ionization.

These and other advantages are provided by the present invention of a powder spray coating system, comprising a power source; an electrical supply line connected to the power source; a spray gun for spraying powder in a spray pattern onto a part, the spray gun including an electrode which charges powder as the powder is dispensed from the gun toward the part, the electrode connected to the electrical supply line; a first current sensing device located in the electrical supply line measuring gun current between the power source and the electrode; an ion collector mounted with the gun for collecting free ions produced by the electrode, the collector having a forward portion positioned near the spray pattern and spaced from the electrode, the collector being connected to a ground line; a second current sensing device located in the ground line measuring back current between the ion collector and ground; and a controller connected between the power source and the electrode to control the gun current, the controller also connected to the first and second current sensing devices for controlling the gun current in accordance with the difference between the measured gun current and the back current.

DETAILED DESCRIPTION OF THE PREFERRED EMBODIMENT

Figure 1:
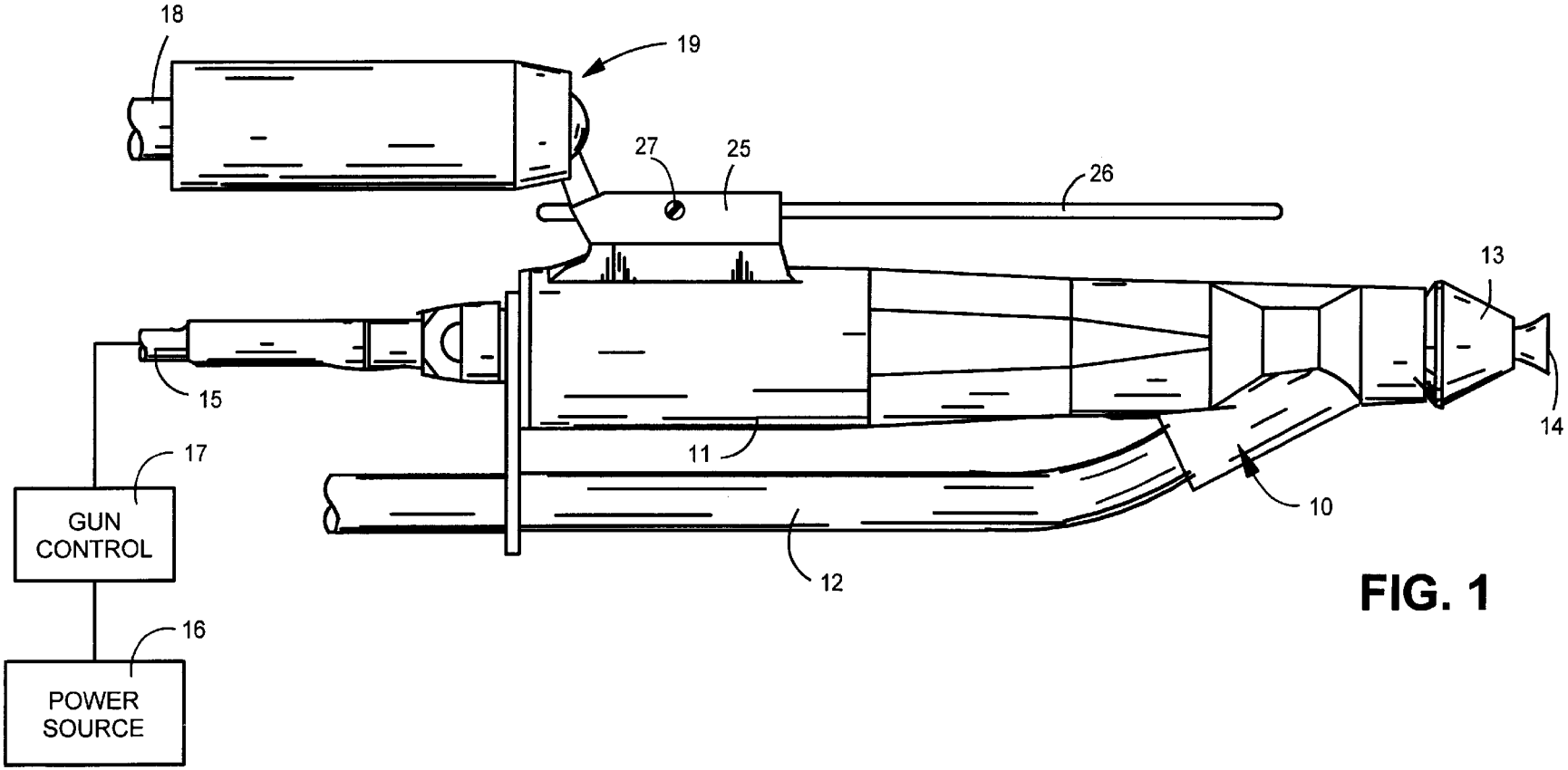
FIG. 1 is a side elevational view of a spray gun having an anti-back-ionization probe attached thereto.

Referring more particularly to the drawings and initially to FIG. 1, there is shown an automatic powder gun 10. The gun 10 is of the type commonly used to spray powder entrained in an air flow onto parts, and the gun includes a body 11, a supply hose 12 connected to the body 11 and supplying powder to the outlet nozzle 13 from which the powder is sprayed onto the parts. An electrical charge is imparted to the powder at the nozzle 13 by an electrode 14. The electrode 14 is typically charged to a large negative potential, such as −100 kV. The electrode 14 is connected to suitable electrical supply components located within the gun body 11 with electricity supplied to the gun through an electrical supply line 15 which is connected to a power source 16 typically supplying 24 volts dc. The power from the power source 16 is supplied to the electrode through a gun controller 17 which regulates the power supply typically between 6–21 volts. This voltage is then transformed to the high voltage utilized by the electrode by high voltage components located within the gun 10. The gun 10 may be mounted on a mounting bar 18 by means of a gun mount assembly 19. Any suitable mounting assembly may be used, the preferred mounting assembly being that disclosed in U.S. patent application Ser. No. 08/959,723.

The gun mount assembly 19 includes a mounting plate 25 having a hole (not shown) extending through the mounting plate from the front face to the rear face of the mounting plate for mounting and supporting a counter electrode or ion collector or anti-back-ionization (ABI) probe 26. Preferably, the probe 26 is a single rod of a strong, highly conductive material, such as brass or aluminum. The probe 26 is held in a fixed position by means a set screw 27 within the opening 25. The probe 26 may be directly grounded through the mounting plate 25, or the probe may be mounted within an insulated sheath (not shown) within the mounting plate so that it may be grounded through an external ground line so that the current running from the probe to ground may be more easily measured as will be further explained below with reference to FIG. 2. At least the forward end of the probe 26 is rounded in a hemispherical shape.

The purpose of the ABI probe 26 is to collect free ions generated at the charging electrode 14 of the spray gun 10. The electrode 14 also creates an electric field which is focused backwardly onto the probe in addition to the electric field which is focused forwardly onto the part. In order to collect most of the ions from the charging electrode of the gun, the distance between the tip of the probe and the tip of the charging electrode should have the proper relationship with the distance between the tip of the charging electrode and the part being sprayed. If this distance relationship is maintained, the electric field between the charging electrode 14 and the probe 26 will be stronger than the electric field between the charging electrode and the part.

By collecting ions with the probe 26 instead of allowing them to deposit on the part, the appearance of the surface finish on the part can be improved. Without the use of the ABI probe, charge would accumulate on the deposited powder layer as the part is sprayed until the local electric field strength is great enough to cause ionization from the powder layer. This "back-ionization" could disturb the deposited powder and result in craters and other defects in the cured coating on the part. By using an ABI probe, these craters and defects are avoided, and a smoother coating is produced. Since the ABI probe collects the ions instead of allowing them to collect on the part, thicker coatings can be produced on the parts because incoming powder is not repelled as quickly by the charged powder deposited. The use of the ABI probe also makes it easier to apply a second coating to parts which have previously been coated because, as previously stated, there is a reduced charge build-up on the part.

Since the electric field which goes from the charging electrode of the gun to the part is weaker because of the ABI probe, the gun should apply a more uniform thickness coating onto the part without a thick coating on the edges. Without the probe, the electric field lines would normally concentrate along the edges, and a thick coating could result in these regions. The weaker field which results from the use of the ABI probe should also result in better coating of the Faraday cage areas on the parts without being diverted toward the edges by a strong electric field. A corona charging gun with an ABI probe should have similar spray characteristics to a tribocharging gun, since a tribocharging gun does not have a high voltage charging electrode, does not create as many ions, and does not create as strong an electric field between the gun and part.

Various other embodiments of the ABI probe can be used, and some of these are shown in the aforementioned U.S. patent application Ser. No. 08/959,723. While the probe 26 shown in FIG. 1 is a single rod of conductive material adjustably held by the set screw 27 in the mounting plate 25, the fixed length of the probe can also be varied by providing a set of different length probes, so the distance could be adjusted by removing a probe of one length and replacing it with another probe of a different length. Alternatively, the ABI probe may comprise one or more sections which may be assembled together as needed to create a probe of desired length. The ABI probe could be made in a telescoping design, similar to those used with retractable antennae. As a further alternative, instead of using the set screw 27 to hold the probe 26 in the opening 25, the probe could have an external thread along its length which matches the internal thread in the hole, so that the user could adjust the effective length of the probe simply by turning the probe clockwise or counter-clockwise.

The ABI probe is preferably an elongated rod extending along the side of the gun body, but it may also be a conductive ring surrounding the gun at a desired distance from the tip of the gun electrode. Furthermore, while the ABI probe 26 is preferably mounted to the mounting plate as shown in FIG. 1, the probe may alternatively be mounted directly onto the gun body at a location other than where the gun mount assembly 19 is attached to the gun. For manually operated spray guns, for example, the probe can be mounted on a bracket attached to the side or top of the gun.

In accordance with the present invention, the current in the system can be summarized by the following formula:

$$I_G=I_T+I_P+I_L$$

where $I_G$ is the supply current flowing to the gun 10 from the power source 16, $I_T$ is the transfer current flowing from the gun 10 to the target or part 30 along with the charged powder, $I_P$ is the back current flowing from the ABI probe 26 to ground, and $I_L$ is the current loss in the system. A constant low current differential should be maintained between the gun and the part in order to maximize the capture of ions and minimize back-ionization at the part.

The gun current $I_G$ and the probe current $I_P$ can be measured. Therefore, the transfer current $I_T$ can be minimized so that, for example, $I_T<\sim 10\ \mu A$, by maintaining $I_G-I_P<\sim 20\ \mu A$, if current loss or leakage current $I_L$ is assumed to be about 10 $\mu$A. The leakage current $I_L$ has been found to be about 10 $\mu$A in many applications, although this value may vary depending upon the parts being coated, the gun being used, and the conditions under which the spraying takes place. Since the transfer current $I_T$ and the leakage current $I_L$ can be determined or set for any desired application, a reference current $I_R$ can be established as $$I_R=I_T+A_L$$

and the gun current IG can be determined by $$I_G=I_P+I_R$$

Figure 2:
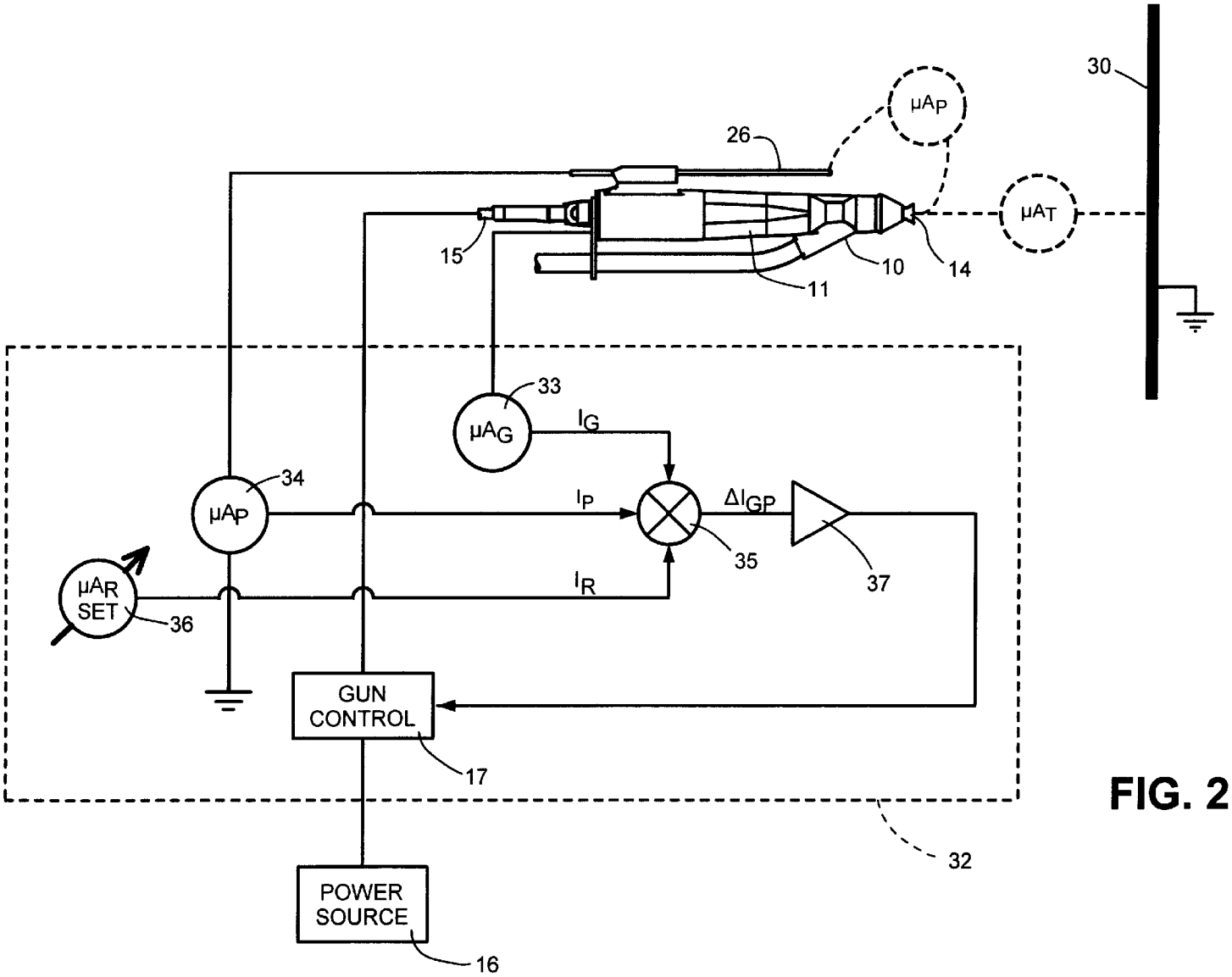
FIG. 2 is a schematic view of a control system in accordance with the present invention.

A control system 32 utilizing the present invention is shown schematically in FIG. 2. A current sensing device or micro-ammeter $\mu A_G$ 33 connected to the power supply components within the gun 10 measures the gun current $I_G$ flowing to the electrode 14. Another current sensing device or micro-ammeter $\mu A_P$ 34 measures the back current $I_P$ flowing back from the ABI probe to ground. The two current readings from the ammeters 33 and 34 are supplied to a comparator 35 along with a reference current $I_R$ supplied from a variable input device 36. The comparator 35 subtracts the back current $I_P$ and the reference current $I_R$ from the measured gun current $I_G$, to arrive at a current differential $\Delta I_{GP}$ which is supplied through an amplifier 37 to the gun controller 17 and used to adjust the gun current. This current differential is thus determined as $$\Delta I_{GP}=I_G-I_P-I_R=0$$

In accordance with this invention, the gun current $I_G$ is adjusted by the gun controller 17 so that the difference $I_G-I_P$ is maintained at a constant low level. The constant level of this difference $I_G-I_P$ is determined by the reference current $I_R$ set by means of the input 36, based upon the desired transfer current $I_T$ and the expected current loss $I_L$. The gun current $I_G$ is then maintained by the gun controller 17 at a level such as to keep the difference $I_G-I_P$ at a constant set level.

The control system 32 of the present invention provides an automatic feedback circuit that allows users to maintain automatically the differential current between the gun electrode and the probe at a certain preset level and, therefore, to keep the ion current from the electrode to the part being coated from rising as distance between the gun and the part changes. This control over the gun current reduces the development of back ionization on the part, as well as reduces the strength of the electric field between the gun and the part as the gun is moved closer to the part. The reduction in field strength, in turn, results in improved penetration of spray power into recessed areas on the part. The control system operates automatically, and there is no need for an operator to adjust any application parameters.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A powder spray coating system, comprising:

a power source;

an electrical supply line connected to the power source;

a spray gun for spraying powder in a spray pattern onto a part, the spray gun including an electrode which charges powder as the powder is dispensed from the gun toward the part, the electrode connected to the electrical supply line;

a first current sensing device associated with the electrical supply line measuring gun current between the power source and the electrode;

an ion collector mounted with the gun for collecting free ions produced by the electrode, the collector having a forward portion positioned near the spray pattern and spaced from the electrode, the collector being connected to a ground line;

a second current sensing device located in the ground line measuring back current between the ion collector and ground; and a controller connected between the power source and the electrode to control the gun current, the controller also connected to the first and second current sensing devices.

2. A powder spray coating system as defined in claim 1, wherein the controller controls the gun current in accordance with the difference between the measured gun current and the back current.

3. A powder spray coating system as defined in claim 1, wherein the controller includes an adjustable input for providing a predetermined reference setting based on optimum coating conditions which is compared to the difference between the gun current and the back current to provide an adjustment to the gun current.

4. A powder spray coating system as defined in claim 1, comprising in addition an input device for inputting a setting corresponding to a desired transfer current from which can be determined the difference between the gun current and the back current.

5. A powder spray coating system, comprising:

a power source;

an electrical supply line connected to the power source;

a spray gun for spraying powder in a spray pattern onto a part, the spray gun including an electrode which charges powder as the powder is dispensed from the gun toward the part, the electrode connected to the electrical supply line;

a first current sensing device located in the electrical supply line measuring gun current between the power source and the electrode;

an ion collector mounted with the gun for collecting free ions produced by the electrode, the collector having a forward portion positioned near the spray pattern and spaced from the electrode, the collector being connected to a ground line;

a second current sensing device located in the ground line measuring back current between the ion collector to ground;

an input for setting a predetermined reference current;

means for subtracting the back current and the reference current from the measured gun current to provide a current differential; and a controller connected between the power source and the electrode to control the gun current, the controller receiving the current differential from the subtracting means and correcting the gun current in accordance therewith.

* * * * *